US005346108A

United States Patent [19]

Pasinski

[11] Patent Number: 5,346,108

[45] Date of Patent: Sep. 13, 1994

[54] GAGED DISPENSING APPARATUS

[76] Inventor: Arthur M. Pasinski, 3440 Bigelow, Howell, Mich. 48843

[21] Appl. No.: 966,280

[22] Filed: Oct. 26, 1992

[51] Int. Cl.[5] ..... B65D 35/00

[52] U.S. Cl. ..... 222/494; 222/495; 222/559; 222/105; 222/212

[58] Field of Search ..... 222/92, 94, 105, 491, 222/494, 495, 96, 103, 496, 212, 107, 547, 559

[56] References Cited

U.S. PATENT DOCUMENTS

| | | | |
|---|---|---|---|
| 1,382,136 | 6/1921 | Stafford | 222/105 |
| 1,382,139 | 6/1921 | Stafford | 222/105 |
| 1,925,926 | 3/1932 | Kunkel | 222/494 |
| 2,332,414 | 10/1943 | Tome | 222/92 |
| 2,556,571 | 6/1951 | Bobbs et al. | 222/494 X |
| 2,613,853 | 10/1952 | Halvorsen | 222/105 X |
| 2,772,819 | 12/1956 | Poarch et al. | 222/394 |
| 2,808,183 | 10/1957 | Olson et al. | 222/498 |
| 2,904,227 | 9/1959 | Graham | 222/207 |
| 3,125,250 | 3/1964 | Ballin | 222/96 |
| 3,456,850 | 7/1969 | Uhlmann | 222/180 |
| 3,587,937 | 6/1971 | Childs | 222/96 X |
| 3,734,350 | 5/1973 | Waterman et al. | 222/494 X |
| 3,754,690 | 8/1973 | Marchant | 222/494 |
| 4,187,960 | 2/1980 | Bonk | 222/107 |
| 4,410,108 | 10/1983 | Minard | 222/494 X |
| 4,526,296 | 7/1985 | Berger et al. | 222/107 |
| 4,616,768 | 10/1986 | Flier | 222/92 |
| 4,684,518 | 8/1987 | Parran, Jr. et al. | 424/52 |
| 4,749,108 | 6/1988 | Dornsbusch et al. | 222/490 X |
| 4,773,458 | 9/1988 | Touzani | 222/107 X |
| 4,838,457 | 6/1989 | Swahl et al. | 222/105 X |
| 4,842,165 | 6/1989 | Van Coney | 222/95 |
| 4,877,624 | 10/1989 | Floyd et al. | 222/494 X |
| 4,941,598 | 7/1990 | Lambelet, Jr. et al. | 222/321 |
| 4,964,538 | 10/1990 | Nimmey et al. | 222/92 |
| 4,979,646 | 12/1990 | Andris | 222/136 |
| 5,137,178 | 8/1992 | Stokes et al. | 222/94 |
| 5,156,300 | 10/1992 | Spahni et al. | 222/105 |
| 5,178,300 | 1/1993 | Haviv et al. | 222/105 X |

FOREIGN PATENT DOCUMENTS

| | | | |
|---|---|---|---|
| 243442 | 4/1960 | Australia | 222/491 |
| 212760 | 3/1941 | Switzerland | 222/105 |
| 724798 | 2/1955 | United Kingdom | 222/494 |
| 2048827 | 12/1980 | United Kingdom | 222/494 |

OTHER PUBLICATIONS

Brochure–Adams Mfg. Product Sheet (including Adams Safety Suction Cups).

Brochure–Thatcher Tubes, Courtaulds Packaging, (Plastic Laminate Collapsible Tubes, Injection Molded Closures, Injection Molded Components and Assemblies).

*Primary Examiner*—Andres Kashnikow
*Assistant Examiner*—Anthoula Pomrening
*Attorney, Agent, or Firm*—Harness, Dickey & Pierce

[57] ABSTRACT

A gaged dispensing apparatus for dispensing a predetermined amount of material to the user. The apparatus comprises a collapsible container and a spherically shaped, resilient metering device disposed within the container. The container is retained within a receptacle which allows the user to apply direct pressure to the collapsible container.

8 Claims, 2 Drawing Sheets

GAGED DISPENSING APPARATUS

BACKGROUND AND SUMMARY OF THE INVENTION

Collapsible tubes and other containers are used to store various types of creams, ointments, pastes, and other viscous materials. Generally, all users will use approximately the same amount of a particular material, for example, toothpaste, soap or shampoo. However, due to the consistency of many of these materials it is often difficult to manually dispense a controlled or predetermined amount of the material. The consistency and viscosity of the material may cause the user to overestimate or underestimate the actual amount of material which is dispensed out of the container.

It is known that some patents have disclosed an external dosing device. For example, U.S. Pat. No. 4,941,598 discloses a dosing cap which is externally attached to a collapsible container. The material flows from the container to the dosing chamber which has a minimum and maximum volume. When the maximum volume of the closing chamber has been reached, the user collapses the chamber, thereby causing the material to be dispensed. U.S. Pat. No. 2,904,227 also discloses an external metering device for a squeeze type container, wherein the metering device uses a piston and metering chamber.

This invention provides a gaged dispensing apparatus comprising a collapsible container having an internal metering device. The reciprocating action of the internal metering device allows a predetermined amount of viscous material or viscous fluid to be dispensed to a user. The container is designed to hold a supply of viscous material or viscous fluid and has a discharge opening and an inclined shoulder portion. Additionally, the container may be mounted within a dispenser receptacle. The dispenser receptacle and container are designed to be disposable once the container has been emptied of the viscous material or fluid.

More particularly, this invention provides a container having a metering device which measures and dispenses a controlled or predetermined amount of viscous material or fluid to the user through a discharge opening. The metering device is internally retained within the container and separates the container into at least two chambers. The metering device generally includes a resilient flexure which is equipped with at least one retaining element. The flexure is formed with a closeable means for permitting or preventing the flow of viscous material or fluid between chambers. The retaining element maintains the flexure in an operable position within the container, such that the ends of the flexure are adjacent to the inclined shoulder portion of the container.

The advantages of the present invention include the metering device disposed internally within a container, thereby providing a more compact apparatus for the user.

Another advantage of the present invention is that the internal metering device provides for a controlled and predetermined amount of viscous material or fluid to be dispensed during each use to the user.

A further advantage of the present invention is that the dispenser allows the container to be displayed and stored on a shelf, thus eliminating additional packaging materials.

A still further advantage of the present invention is that the dispenser receptacle is designed to be molded of a transparent material which allows a user to easily view any instructions, company logo or trademark printed directly on the container.

Another advantage of the present invention is that the dispenser and container are both designed to be disposable.

From the following detailed description taken in conjunction with the accompanying drawings and subjoined claims, other advantages of the present invention will become apparent to those skilled in the art.

BRIEF DESCRIPTION OF THE DRAWINGS

This invention will now be described with reference to the accompanying figures wherein.

DETAILED DESCRIPTION OF THE PREFERRED EMBODIMENT

Figure 1:
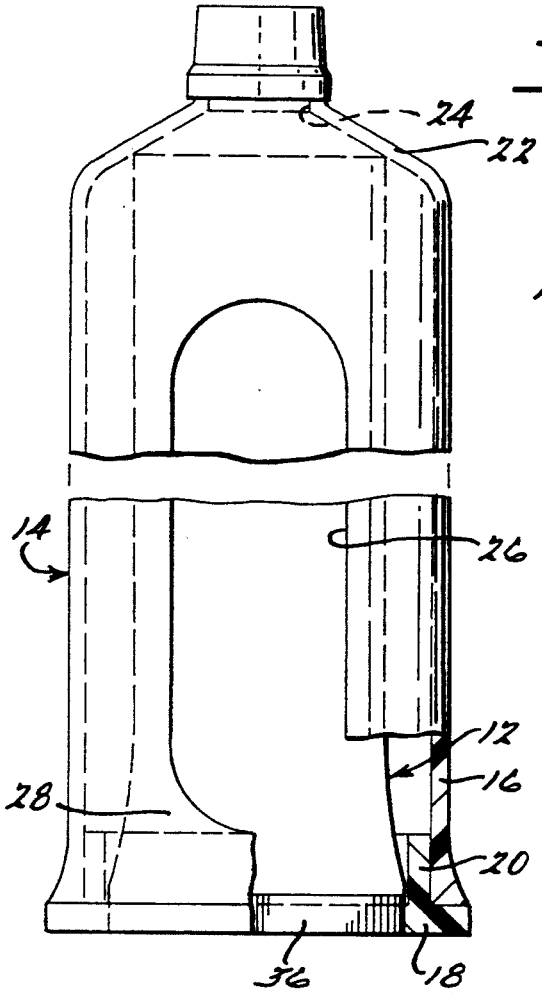
FIG. 1 is a perspective view of the collapsible tube mounted within a dispenser receptacle.

Referring to FIG. 1, a gaged dispenser 10 according to the present invention is shown. More particularly, the gaged dispenser 10 includes a container which is in the form of a collapsible tube 12. The gaged dispenser 10 also preferably includes a receptacle 14 which supports the collapsible tube 12. The collapsible tube 12 is used to hold various types of viscous materials or fluids. Generally, the collapsible tube 12 is designed to hold different types of materials, including fluids, pastes, cremes, ointments, and other types of viscous materials. The collapsible tube 12 may be made of various commercially available materials which do not react with the viscous materials or fluids contained in the tube 12, such as drawn metals, laminated foils and films. For example, Thatcher Tubes of Florence, Kentucky , makes plastic laminate collapsible tubes and injection molded closures for the these tubes. In this regard the closure corresponds to the neck 30 and shoulder 44 portions of tube 12. With such a construction, the closure is secured to one end of the laminate collapsible tube, such that the end of the closure resides inside the tube. However, it should be understood that the invention may also be utilized with tubes in which both the tube wall and the neck and shoulder portions are all constructed of metal.

Figure 2:
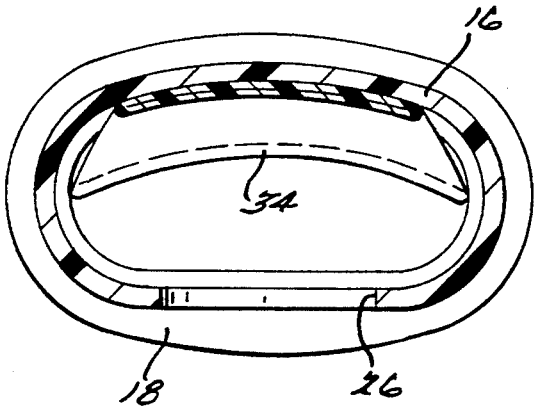
FIG. 2 is a horizontal cross-sectional view of the collapsible tube and dispenser receptacle of FIG. 1.

As shown in FIG. 1, the collapsible tube 12 is vertically supported within the receptacle 14. In this regard, the receptacle 14 should be proportioned such that it will easily fit within the hand of an average user. The receptacle 14 is preferably made of a transparent material such as polyethylene or polypropylene. The transparent material allows the user to easily view instructions, company logos or trademarks printed directly on the collapsible tube 12. The receptacle 14 includes a housing 16 and a base 18. As shown in FIG. 2, the receptacle housing 16 is generally elliptically shaped. Accordingly, the base 18 also has a generally elliptical shape and is formed with a vertical ridge 20 extending circumferentially around the base 18. The receptacle housing 16 is tapered at the upper end to form a shoulder portion 22. The receptacle housing 16 also has a generally circular aperture 24 adjacent to the shoulder portion 22. The lower end of the receptacle housing 16 is generally perpendicular to the base 18. A pressure fit connection may be used to secure the receptacle housing 16 to the ridge 20 of the base 18. Alternatively, an adhesive or ultra-sonic weld may be provided between the ridge 20 of the base 18 and the receptacle housing 16 for permanently securing the base 18 and receptacle housing 16. The receptacle housing 16 also has an elongated aperture 26 which extends substantially the entire length of a front section 28 of the receptacle housing 16. The aperture 26 permits a user to apply direct pressure to the collapsible tube 12 with their thumb. In this regard, it should be noted that this arrangement makes it substantially easier for a user to apply the pressure needed to convey the viscous fluid up the collapsible tube 12. More specifically, the user will be able to dispense a measured amount of the fluid material with only one hand.

The collapsible tube 12 is securely held within the receptacle 14. The collapsible tube 12 includes a neck 30 which is formed with a discharge opening 32. The neck 30 of the collapsible tube 12 is retained within the circular aperture 24 within the receptacle housing 16. In addition, as illustrated in FIG. 2, the base 18 is provided with an slot 34 for receiving a bottom edge 36 of the collapsible tube 12. The size of the slot 34 is dependant upon the diameter of the collapsible tube 12. The slot 34 may have an arc shape similar to the arc of the ridge 20. The proximity of the slot 34 to the ridge 20 helps ensure that when direct pressure is applied to the collapsible tube 12, the collapsible tube 12 will directly contact the receptacle housing 16 and conform to the shape of the receptacle housing 16. This arrangement also helps to prevent back flow of viscous material or fluid within the collapsible tube 12, when the user is not applying pressure.

FIGS. 3–7 illustrate a metering device 38 in accordance with the present invention, which is internally disposed within the collapsible tube 12. The location of the metering device 38 defines a first chamber 40, holding a supply of viscous material, and a second chamber 42, in fluid communication with the discharge opening 32. The metering device 38 is adapted to measure a predetermined volume of viscous material to be dispensed to the user. The metering device 38 generally comprises a flexure element, which is retained within the collapsible tube 12 and acts as a partially movable wall between the first chamber 40 and second chamber 42. The flexure 38 is preferably formed of resilient plastic materials which are inert to the viscous materials stored within the collapsible tube 12, such as polyurethane. In one embodiment according to the present invention, the flexure 38 is made of B. F. Goodrich 86272 polyvinyl chloride. However, it should be appreciated that the flexure 38 may be made from other suitable materials which facilitate a reciprocable motion.

Figure 5:
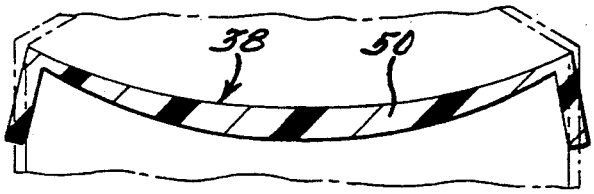
FIG. 5 is a cross sectional view of the flexure of FIG. 3.
Figure 6:
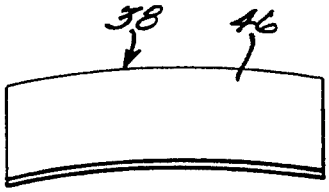
FIG. 6 is a side elevation view of the flexure of FIG. 3.

The flexure 38 is maintained within the collapsible tube 12, adjacent to the inclined shoulder portion 44 of the collapsible tube 12, by one or more retaining components, such as a pair of opposing arms 46–48. As shown in FIG. 5, the opposing arms 46–48 preferably extend in a downward and radially outward direction to provide a gripping action. However, it should be understood that the opposing arms 46–48 may be replaced by other retaining elements, such as a suitable rib or notch formed in the shoulder 44. The flexure 38 may be installed in the collapsible tube 12 in coordination with the filling of the tube with the desired fluid material. Alternatively, when the invention is to be employed in a tube construction having a separate laminate tube and plastic closure, the flexure 38 may be placed in the closure before it is secured to the laminate tube. In this regard, the opposing arms 46–48 may be ultra-sonically welded or otherwise bonded to the shoulder 44 in order to ensure that the flexure 38 is retained in the closure during the assembly process.

Figure 3:
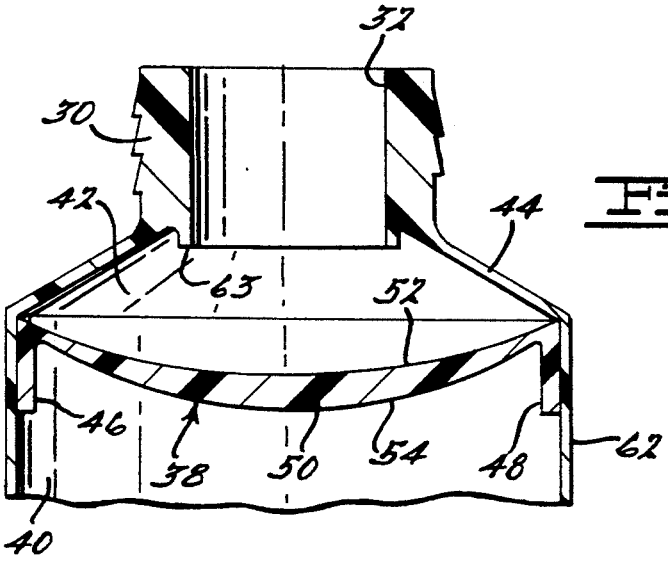
FIG. 3 is a partial longitudinal cross-sectional view of the collapsible tube illustrating the flexure in a first position.
Figure 4:
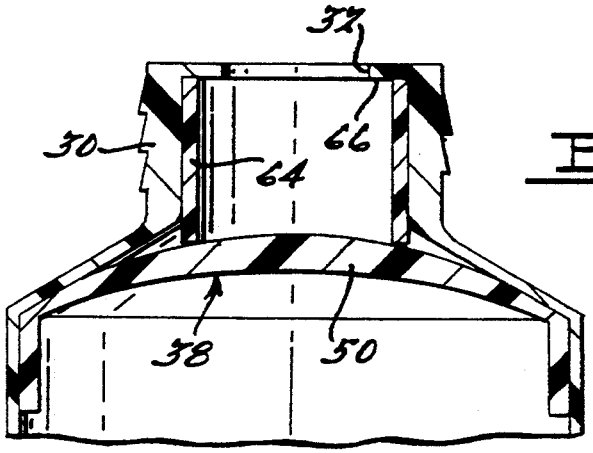
FIG. 4 is a partial longitudinal cross-sectional view of another embodiment of the collapsible tube illustrating the flexure in a second position.

The shape of the flexure 38 may be readily understood by a comparison of FIGS. 3–7. In the first place, FIGS. 3 and 4 show that the flexure 38 has a central body portion 50 which is tapered such that the body portion 50 is thicker in the middle than it is at the ends (toward the opposing arms 46–48). Importantly, it should be noted that this gradual taper extends spherically from the center of the body portion 50. In other words, the thickness of the body portion 50 decreases from the center in each radial direction. Accordingly, it should be understood that both the upper surface 52 and the lower surface 54 of the body portion 50 have a generally smooth and continuous spherical shape. However, the spherical arcs of the surfaces 52 and 54 are different in order to create the desired taper in thickness. It is also important to note that the flexure 38 is positioned in the collapsible tube 12 such that the spherical shape of the body portion 50 is bowed toward the fluid material and away from the discharge opening 32. This preferred configuration for the cross-sectional shape of the body portion 50 enhances the spring-action of the flexure 38 as the body portion is moved from the initial open position shown in FIG. 3 to the closed position shown in FIG. 4.

Figure 7:
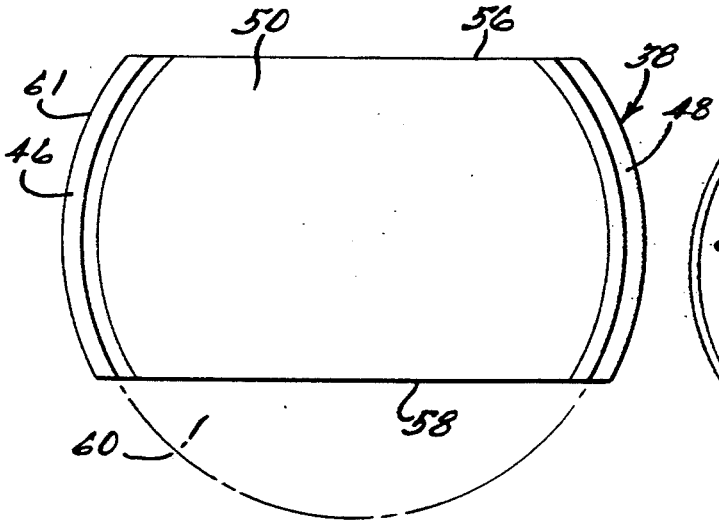
FIG. 7 is a top elevation view of the flexure.

FIG. 7 also shows that the body portion 50 is formed with opposing side edges 56 and 58 which are used to define a pair of apertures (e.g., aperture 60) in combination with the cylindrical wall 61 of the collapsible tube 12. While the side edges 56–58 are shown to have a generally linear shape, it should be appreciated that other suitable shapes for the side edges could be employed in the appropriate application. Nevertheless, it should be appreciated that the width of body portion 50 between the side edges 56–58 will affect the reciprocating action of the flexure 38 and the volume of material dispensed. The volume of material dispensed will also be affected by the length of the body portion 50. Additionally, if the flexure 38 is compressed when it is placed within the tube 12, then the volume of material dispensed will be increased, as the amount of travel between the open and closed positions will be increased. In order to move the body portion 50 of the flexure 38 toward the opening 32, the fluid needs to press against a sufficient surface area of the body portion, which is provided by the surface 54. Accordingly, the surface area of the body portion needs to be greater than the surface area of the openings around the flexure (e.g., aperture 60). Preferably, the length of the arc defined by the cylindrical edge 62 should be equal to or greater than one fourth the circumference defined by the interior dimension of the cylindrical wall for the collapsible tube 12. However, it should be understood that the shape of the flexure 38 may be modified to conform to the interior shape of various types of containers, such as pump dispensers and squeeze bottles. Additionally, the magnitude of the width of the body portion 50 needs to be wide enough to enable the flexure to close off the lower end of the opening 32 when the flexure is in the position shown in FIG. 4.

As discussed above, the body portion 50 of the flexure 38 is adapted to move between two different positions depending upon the pressure applied to the collapsible tube 12. When the flexure 38 is in the first position as illustrated in FIG. 3, viscous material is conveyed from the first chamber 40 to the second chamber 42 via the side apertures 60. When the flexure 38 is in the second position as illustrated in FIG. 4, the body portion 50 will prevent any further viscous material from being conveyed to the second 42 chamber from the first chamber 40. In this regard, the upper surface 52 of the body portion 50 will be in contact with the shoulder portion 44 of the collapsible tube, and the lower end of the opening 32 will be temporarily sealed by contact with the body portion 50.

It should also be observed that FIGS. 3 and 4 present different embodiments of the collapsible tube 12 in accordance with the present invention. In this regard, FIG. 3 represents the preferred embodiment. Specifically, FIG. 3 shows that the neck 30 is formed with an integral downwardly projecting annular ridge 63. The annular ridge 63 may be used to help control the volume of fluid material to be dispensed. For example, in the case of a laminated tube construction, different plastic closure designs could be provided with the variation being the length that the annular ridge extends below the shoulder 44 portion.

Figure 8:
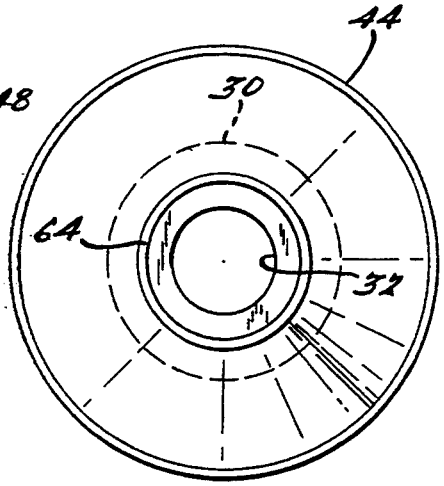
FIG. 8 is a cross-sectional view of the gaged dispenser.
Figure 9:
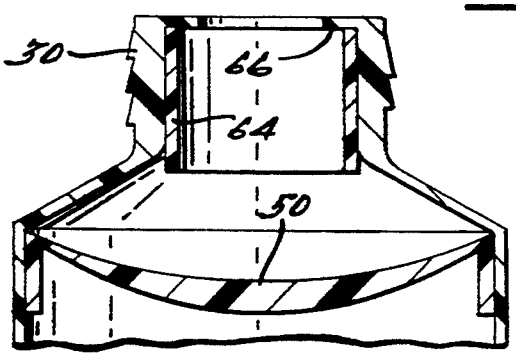
FIG. 9 is a partial longitudinal cross-sectional view of the collapsible tube of FIG. 4 with the flexure in the first position.

Alternately, as shown in FIGS. 4, 8 and 9, the collapsible tube 12 may also include a plastic sleeve 64 which resides in the neck 30 of the collapsible tube. In this regard, the sleeve 64 should be installed in the neck 30 before the flexure 50 is installed in the collapsible tube 12. The vertical position of the sleeve 64 in the neck 30 may be adjusted to permit to control the volume of fluid material to be dispensed. While the sleeve 64 may be constructed to having a sliding press fit relationship with the neck 30, other suitable relationships could also be provided. Thus, for example, if the sleeve 64 is moved in a direction toward the flexure 38, it should be understood that the flexure will close the lower end of the opening 32 more quickly, and thereby permit less fluid material to be dispensed. The discharge opening 32 may also be formed with a lip 66 which extends in a radially inward direction in order to prevent the sleeve 64 from being inadvertently removed from the collapsible tube 12. Nevertheless, the sleeve 64 may be molded integrally with the neck 30 in order to provide a fixed vertical position, as shown in FIG. 3.

In operation, when a user subjects the collapsible tube 12 to direct pressure a defined amount of viscous material begins to flow through the collapsible tube 12 towards the opening 32. As the pressure within the collapsible tube 12 increases, a defined amount of viscous material flows from the first chamber 40 to the second chamber 42 via the apertures 60 created between the side edges 56–58 of the flexure 38 and the cylindrical wall 62 of the collapsible tube. As the viscous material continues to flow from the first chamber 40 to the second chamber 42, body portion 50 of the flexure 38 begins to deflect and move from the first position to the second position. As the flexure 46 moves into the second position, the apertures 60 are closed, and further viscous material is prevented from entering the second chamber 42. In this sense, the flexure 38 acts as a shut off valve as the body portion 50 reaches the fully dispensed position. The movement of the body portion 50 of the flexure 38 forces a predetermined amount of viscous material within the second chamber 42 through the neck 30 of the collapsible tube 12 and out to the discharge opening 32. In this sense, it should be appreciated that the flexure 38 acts as a fluid pump.

Once the viscous material is dispensed through the discharge opening 32 and there is no pressure being applied to the collapsible tube 12, the body portion 50 of the flexure 46 returns to the first position. It should be appreciated that the shape and resilient material of the flexure 38 provide a spring action which will assist the return movement of the body portion to the first position once the pressure on the collapsible tube 12 has been released. At this time, the flexure 38 is a suck-back valve, which draws back viscous material and clears the area of the discharge opening. In other words, the flexure 38 will automatically return to its starting position without any external assistance. Therefore, when the collapsible tube 12 is again subjected to pressure, the above described method will be repeated. This procedure will continue until the viscous material within the collapsible tube 12 has been exhausted. It should also be understood that a wide variety of fluid materials may be dispensed in accordance with the present invention. For example, the dispensing apparatus 10 may be used with toothpaste, liquid soap (with sufficient consistency to move the body portion 50 under pressure), hair gel and so forth.

While the above detailed description describes the preferred embodiments of the present invention, it will be understood that the present invention is susceptible to modification, variation and change without departing from the scope and fair meaning of the subjoined claims.

I claim:

1. A gaged dispensing apparatus, comprising:

a container for holding a supply of a viscous material, said container having an opening at one end thereof for permitting the discharge of said viscous material from said container; and resilient metering means, interposed between a first chamber of said container which holds a supply of viscous material and a second chamber of said container which communicates with said opening, for limiting the volume of said material dispensed through said opening to a predetermined volume in response to the application of pressure to said first chamber of said container, said resilient metering means including a plastic reciprocating element which has a body following a generally spherical arc that is normally bowed away from said opening of said container, and aperture means formed at least in part by said reciprocating element for permitting said viscous material to flow from said first chamber to said second chamber until said generally spherically arcing body provides a metering seal between said first and second chambers in a closed position, said seal preventing discharge of additional viscous material from said opening.

2. A gaged dispensing apparatus according to claim 1, wherein said reciprocating element includes means for retaining said generally spherically arcing body in a predetermined position within said container.

3. A gaged dispensing apparatus according to claim 1, wherein said body of said reciprocating element prevents material flow between said first and said second chamber when said generally spherically arcing body of said reciprocating element has moved to said closed position in response to the application of pressure.

4. A gaged dispensing apparatus according to claim 3, wherein said reciprocating element is made from a urethane material.

5. A gaged dispensing apparatus according to claim 2, wherein said means for retaining comprises a pair of opposing arms which extend, at least in part, in a radially outward direction.

6. A gaged dispensing apparatus according to claim 5, wherein said pair of opposing arms are integrally formed with said reciprocating element.

7. A gaged dispensing apparatus according to claim 1, wherein said generally spherically arcing body of said reciprocating element has an upper surface and a lower surface, said upper surface following a different generally spherical arc than said lower surface.

8. A gaged dispensing apparatus according to claim 7, wherein said generally spherically arcing body of said reciprocating element has a thickness at an apex which is greater than the thickness at opposing ends of said body.

* * * * *